US008128543B1

(12) United States Patent
Liao Lai

(10) Patent No.: US 8,128,543 B1
(45) Date of Patent: Mar. 6, 2012

(54) TWIST EXERCISER

(76) Inventor: Shu-Chiung Liao Lai, Taichung (TW)

( * ) Notice: Subject to any disclaimer, the term of this patent is extended or adjusted under 35 U.S.C. 154(b) by 0 days.

(21) Appl. No.: 12/857,539

(22) Filed: Aug. 16, 2010

(51) Int. Cl.
*A63B 26/00* (2006.01)

(52) U.S. Cl. ..... 482/142; 297/340

(58) Field of Classification Search ..... 482/51, 482/52, 53, 62, 70, 73, 79, 95, 96, 123, 131, 482/136, 140, 142, 146, 147; D21/699, 689, D21/698; 297/340, 535, 353
See application file for complete search history.

(56) References Cited

U.S. PATENT DOCUMENTS 4,129,916 A * 12/1978 Schlesinger et al. ..... 14/69.5
4,494,662 A * 1/1985 Clymer ..... 482/123
5,423,729 A * 6/1995 Eschenbach ..... 482/70
6,022,303 A * 2/2000 Abdo ..... 482/140
6,149,552 A * 11/2000 Chen ..... 482/72
6,248,047 B1 * 6/2001 Abdo ..... 482/130
6,402,669 B1 * 6/2002 Olstad ..... 482/123
6,616,580 B1 * 9/2003 Chen ..... 482/123
7,147,589 B2 * 12/2006 Chae ..... 482/51
2008/0058184 A1 * 3/2008 Hale ..... 482/142

* cited by examiner

*Primary Examiner* — Loan Thanh
*Assistant Examiner* — Tam Nguyen

(57) ABSTRACT

A twist exerciser includes a base, a first gear unit, a second gear unit, a seat, a feet rest and a handle unit. The first gear unit includes a first shaft rotatably connected to the base and a first gear is fixed to the first shaft and co-rotated with the first shaft. The second gear unit includes a second shaft rotatably connected to the base and a second gear is fixed to the second shaft and co-rotated with the second shaft. The seat is connected to a top end of the first shaft and co-rotated with the first gear. The feet rest has a first end fixed to the first shaft and a second of the feet rest has a transverse bar. The handle unit has a handle and drives the second shaft. The exerciser is easily operated and has simple structure and less noise.

6 Claims, 14 Drawing Sheets

TWIST EXERCISER

FIELD OF THE INVENTION

The present invention relates to an exerciser, and more particularly, to a twist exerciser which has simple structure and is easily operated to exercise abdominal muscles and back muscles.

BACKGROUND OF THE INVENTION

A conventional twist exerciser generally includes a twist disk and a stationary handle, the user stands on the disk and holds the handle. The user twists his/her lower body to rotate the disk so as to exercise the muscles of the abdomen and back. However, due to the angle that the disk is rotated is controlled by the user who twists his/her lower body so that the result of the exerciser is almost the same as the user twists his/her lower body without using the exerciser. In addition, the user holds the stationary handle by two hands and only the lower body rotates, this action may not be convenient for the elder uses and injury to the muscles may happen if the users twist too much. Furthermore, the user has to stand on the disk to operate the exerciser so that the uses who have weak physical condition may not be able to properly operate the exerciser.

Although other twist exercisers are developed, most include complicated link and/or gear systems which have high maintenance and manufacturing costs.

The present invention intends to provide a twist exerciser that improves the drawbacks of the conventional twist exercisers.

SUMMARY OF THE INVENTION

The present invention relates to a twist exerciser which includes a base, a first gear unit, a second gear unit, a seat, a feet rest and a handle unit. The first gear unit includes a first shaft rotatably connected to the base and a first gear 21 is fixed to the first shaft and co-rotated with the first shaft. The second gear unit includes a second shaft rotatably connected to the base and a second gear is fixed to the second shaft and co-rotated with the second shaft. The seat is connected to a top end of the first shaft and co-rotated with the first gear. The feet rest has a first end fixed to the first shaft and a second of the feet rest has a transverse bar. The handle unit has a handle and drives the second shaft. The exerciser is easily operated and has simple structure and less noise.

By the engagement between the first and second gears, the handle unit and the seat are rotated in opposite directions so as to achieve the purpose that the upper body and the lower body are twisted in opposite directions. Therefore, the abdominal muscles and the back muscles are exercised. In addition, the structure is simple and the operation is easy. The engagement of the first and second gears generates less noise.

The handle unit comprises a driving post and a foam tube. The driving post has a top end connected to the handle and a bottom end of the driving post is connected with the second shaft. The foam tube is mounted to the driving post. The driving post comprises a spring, an upper tube unit and a lower tube unit. The upper tube unit has a top end connected to the handle and a top end of the spring is mounted to a bottom end of the upper tube unit. A lower end of the spring is mounted to a top end of the lower tube unit and a bottom end of the lower tube unit is connected to the second shaft. The foam tube is mounted to the spring. By the spring, the driving post is bent to any direction when the driving post is applied by a force so as to provide a safe operation to the users.

The base, the feet rest and the upper tube unit are retractable so as to adjust their length.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
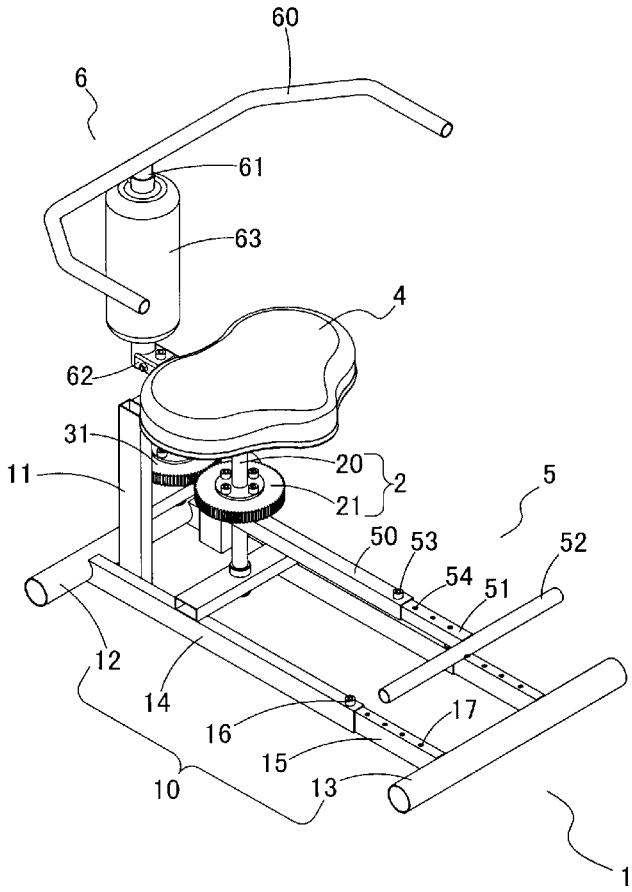
FIG. 1 is a perspective view to show the twist exerciser of the present invention.
Figure 2:
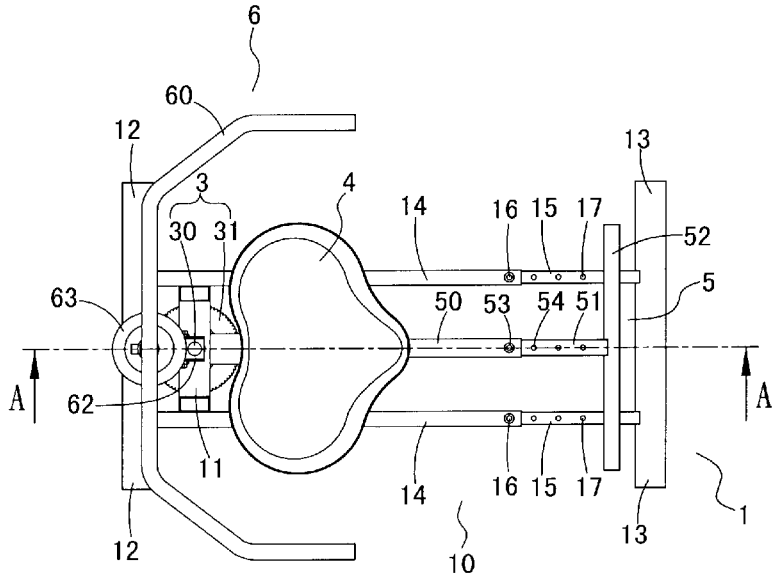
FIG. 2 is a top view of the twist exerciser of the present invention.
Figure 3:
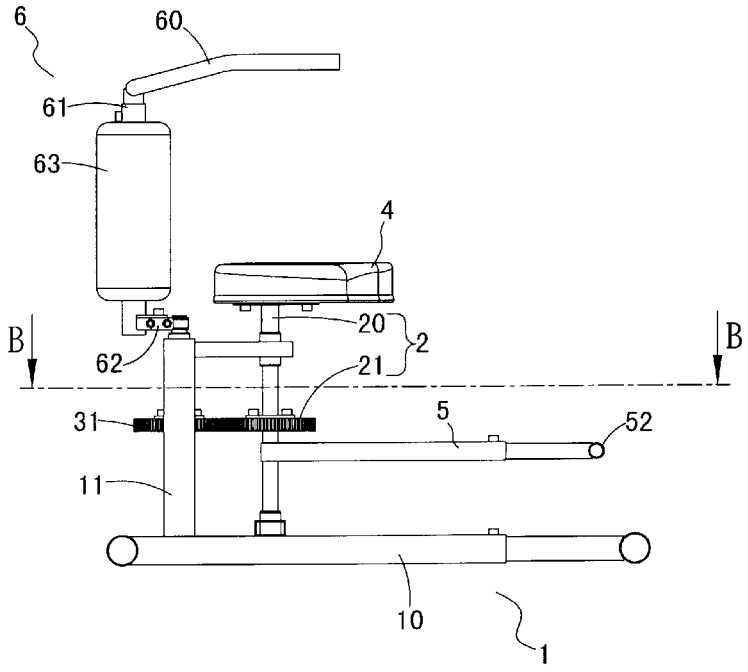
FIG. 3 is a front view of the twist exerciser of the present invention.
Figure 4:
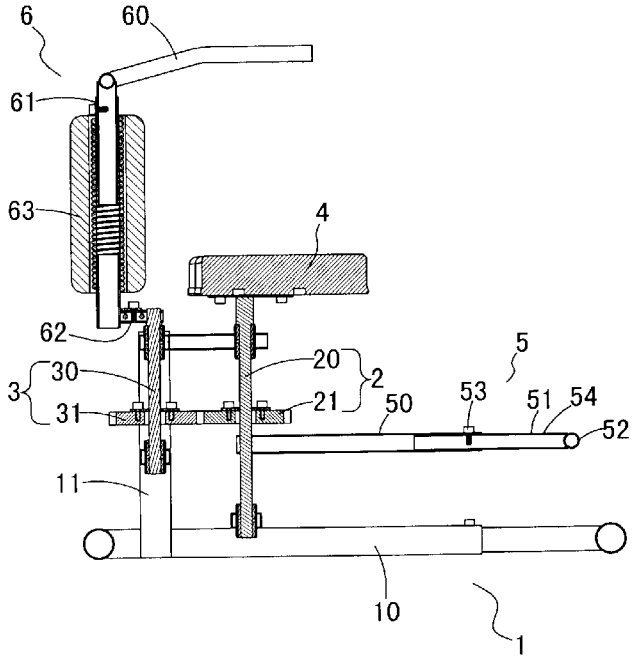
FIG. 4 is a cross sectional view, taken along line A-A of FIG. 2.
Figure 5:
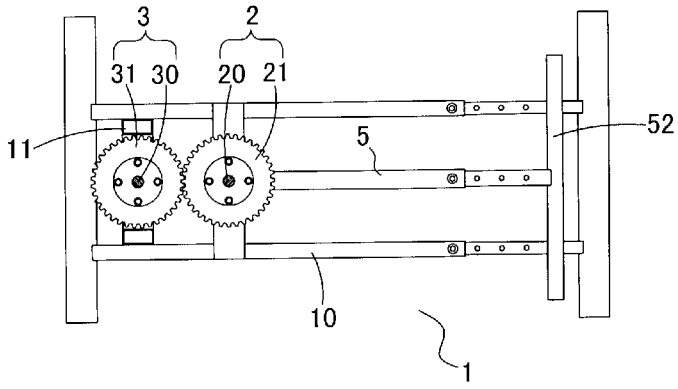
FIG. 5 is a cross sectional view, taken along line B-B of FIG. 3.

Referring to FIGS. 1 to 5, the twist exerciser of the present invention comprises a base 1, a first gear unit 2, a second gear unit 3, a seat 4, a feet rest 5 and a handle unit 6.

The base 1 comprises a main part 10 and a connection frame 11 which is connected to the main part 10.

The first gear unit 2 comprises a first shaft 20 and a first gear 21 which is fixed to the first shaft 20.

The first shaft 20 is rotatably connected to the base 1 and the first gear 21 is fixed to the first shaft 20 and co-rotated with the first shaft 20. The top end of the first shaft 20 is pivotably connected to the connection frame 11 and extends out from the top of the connection frame 11. The bottom end of the first shaft 20 is pivotably connected to the main part 10.

The second gear unit 3 comprises a second shaft 30 and a second gear 31 which is fixed to the second shaft 30. The second shaft 30 is rotatably connected between the connection frame 11 of the base 1 and the second gear 31 is co-rotated with the second shaft 30. The first and second gears 21, 31 are engaged with each other. The seat 4 is connected to the top end of the first shaft 20 and co-rotated with the first gear 21. A user can sit on the seat 4.

The feet rest 5 has a first end fixed to the first shaft 20 and a second end of the feet rest 5 has a transverse bar 52. The feet rest 5 comprises a first tube 50, a second tube 51, the transverse bar 52 and a bolt 53. The first and second tubes 50, 51 are retractably connected to each other. The first tube 50 is fixed to the first shaft 20 and the transverse bar 52 is fixed to the second tube 51 so that the user's feet may rest on the transverse bar 52. The second tube 51 includes multiple positioning holes 54 and the bolt 53 extends through the first tube 50 and is engaged with one of the positioning holes 54 to set the length of the feet rest according to the users' needs.

The main part 10 comprises a rear rod 12 and a front rod 13, two outer tubes 14, two inner tubes 15 and two bolts 16. The two outer tubes 14 are parallel to each other and have two respective ends connected to the rear rod 12. The two inner tubes 15 have two respective first ends inserted into the two outer tubes 14 and two respective second ends of the two inner tubes 15 are connected to the front rod 13. The two inner tubes 15 each have multiple positioning holes 17. Each of the two bolts 16 extends through the outer tube 14 corresponding thereto and is engaged with one of the positioning holes 17 of the inner tube 15 corresponding thereto so as to adjust the length of the base 1.

Figure 6:
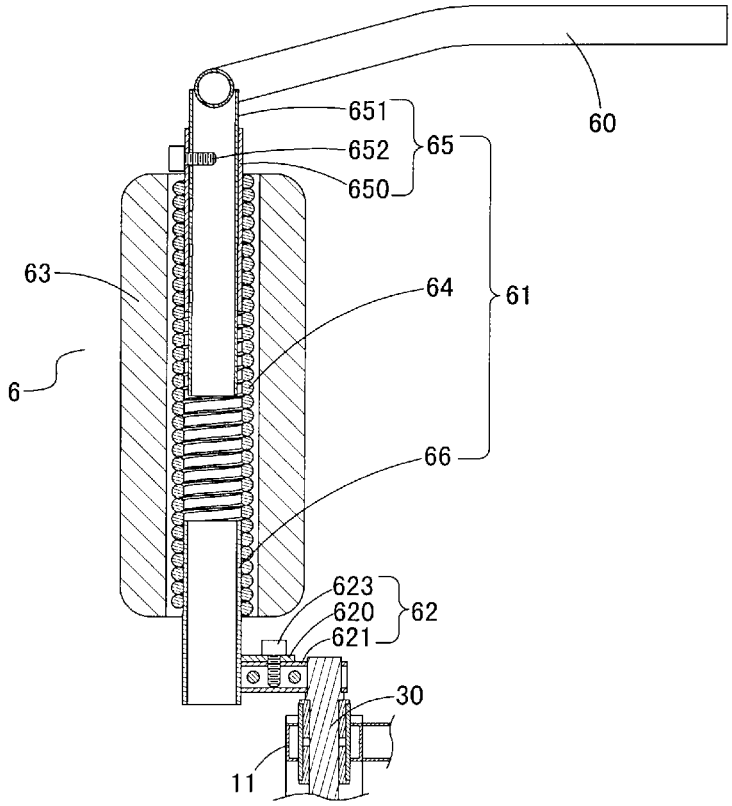
FIG. 6 is a cross sectional view of the handle unit of the twist exerciser of the present invention.

Referring to FIG. 6, the driving post 61 of the handle unit 6 comprises a spring 64, an upper tube unit 65 and a lower tube unit 66. The foam tube 63 is mounted to the spring 64. The upper tube unit 65 comprises a lower tube 650, an upper tube 651 and a bolt 652. The lower tube 650 is inserted into the spring 64 and the top end of the upper tube 651 is connected to the handle 60. The bottom end of the upper tube 651 is inserted into the lower tube 650. The upper tube 651 includes multiple positioning holes 653. The bolt 652 extends through the lower tube 650 and is inserted into one of the positioning holes 653 so as to adjust the height of the handle 60.

The bottom end of the lower tube unit 66 is connected to the extension 62 and the top end of the lower tube unit 66 is inserted into the lower end of the spring 64.

By this arrangement, the spring 64 drives the driving post 61 to bend toward any direction when a force is applied thereto, such that a safe operation is provided.

The extension 62 comprises a first connection member 620, a second connection member 621 and a bolt 623. The first connection member 620 is connected to the driving post 61 and the second connection member 621 is connected to the second shaft 30. The first and second connection members 620, 621 are retractably connected to each other. The bolt 623 connects the first and second connection members 620, 621 together.

Figure 7:
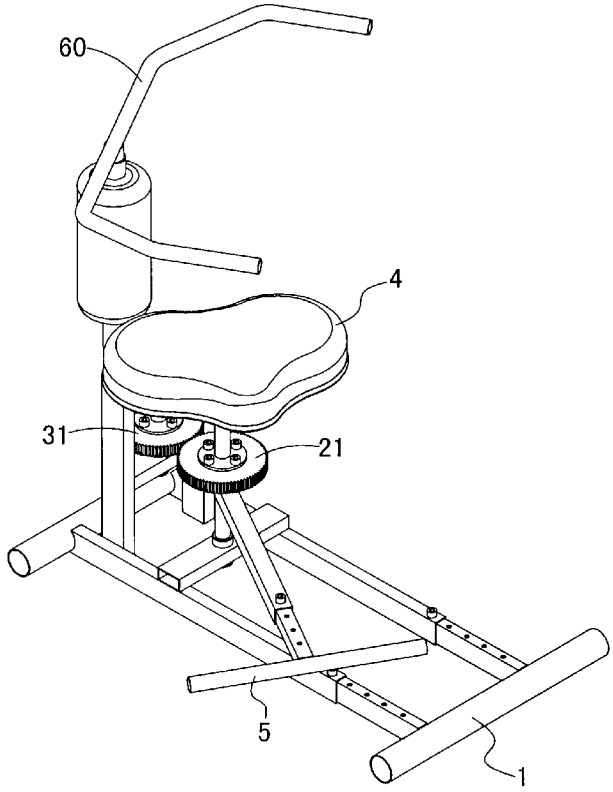
FIGS. 7 and 8 show that the handle is pivoted counter clockwise and the seat is pivoted clockwise.
Figure 8:
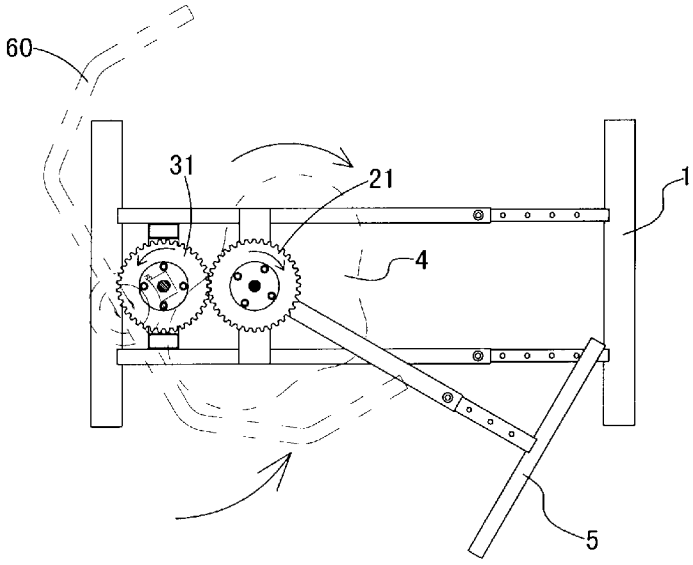

Referring to FIGS. 7 and 8, when the handle 60 is pivoted counter clockwise, the second gear 31 is rotated counter clockwise and the first gear 21 is rotated clockwise. The seat 4 and the feet rest 5 are pivoted clockwise, so that the user's upper body and the lower body twist in two opposite directions.

Figure 9:
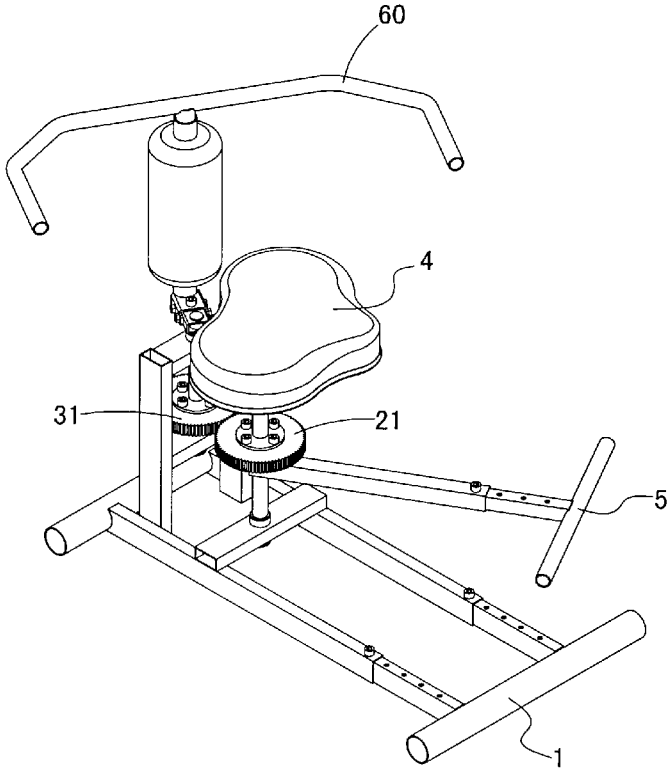
FIGS. 9 and 10 show that the handle is pivoted clockwise and the seat is pivoted counter clockwise.
Figure 10:
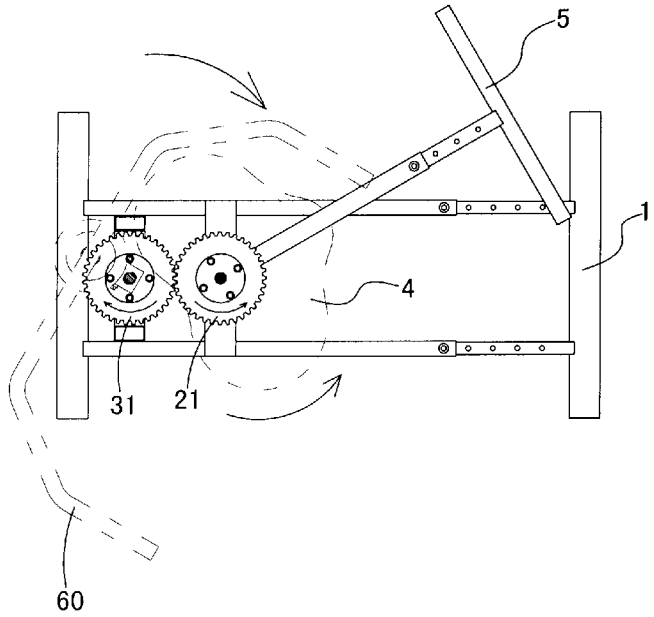

Referring to FIGS. 9 and 10, when the handle 60 is pivoted clockwise, the second gear 31 is rotated clockwise and the first gear 21 is rotated counter clockwise. The seat 4 and the feet rest 5 are pivoted counter clockwise, so that the user's upper body and the lower body twist in two opposite directions.

Figure 11:
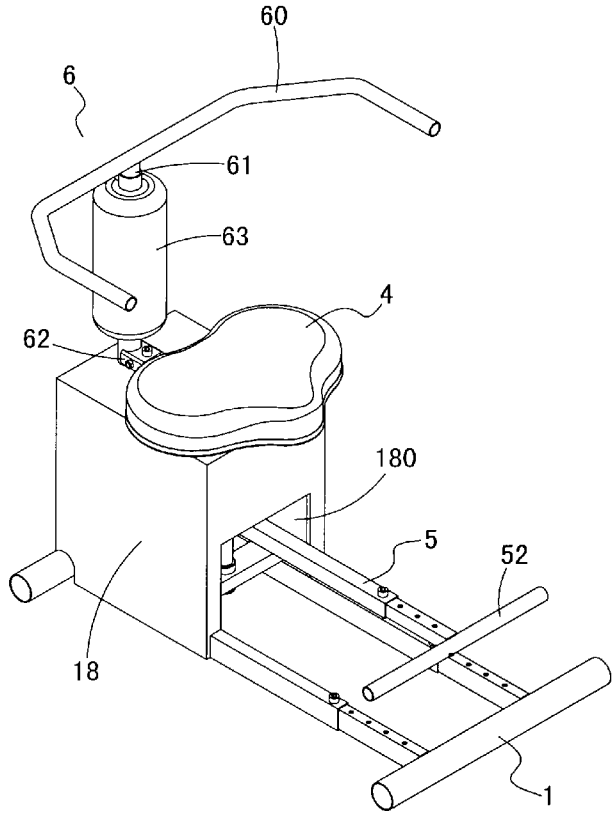
FIGS. 11 and 12 show another embodiment of the base of the twist exerciser of the present invention.
Figure 12:
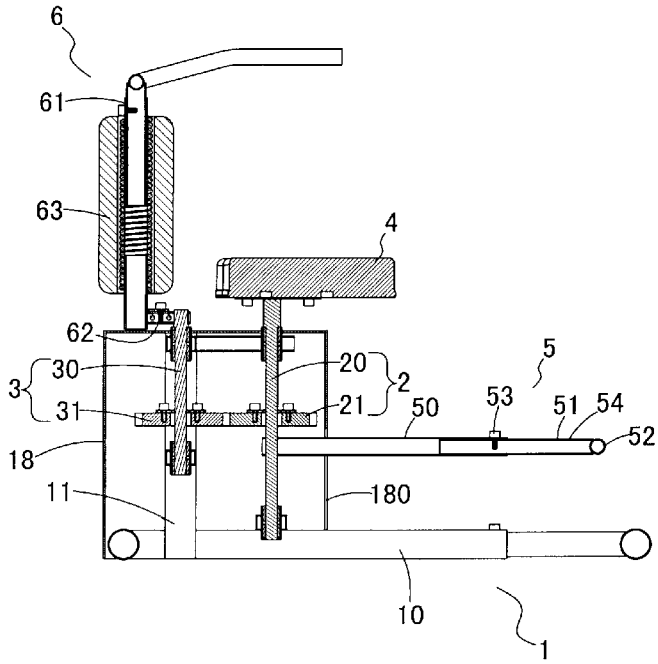

FIGS. 11 and 12 show that the base 1 further comprises a case 18 which is mounted to the first and second gears 21, 31. The case 18 includes an opening 180 so that the feet rest 5 can move via the opening 180.

Figure 13:
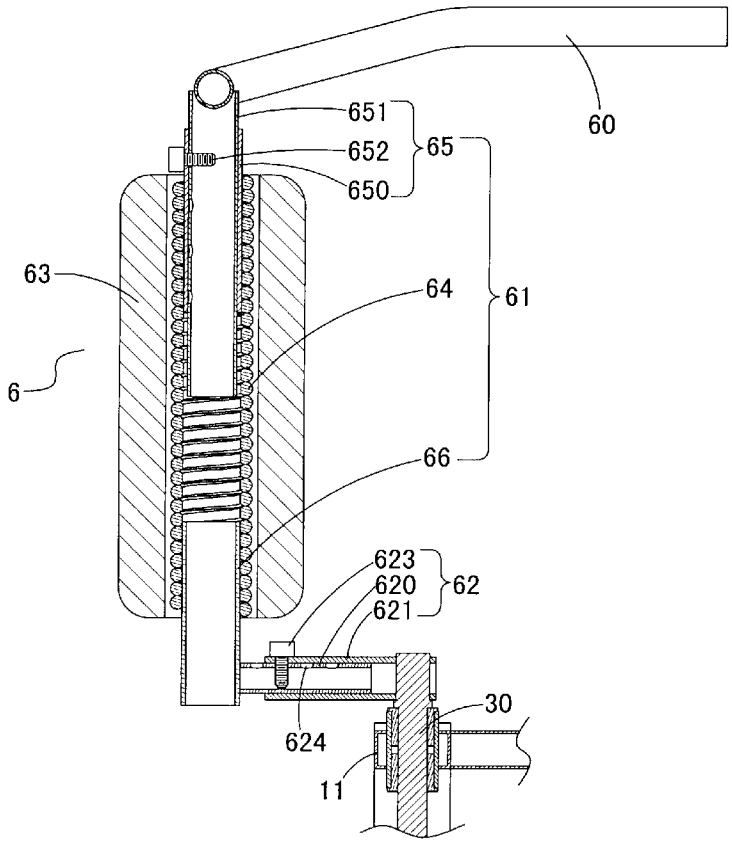
FIG. 13 shows another embodiment of the handle unit of the twist exerciser of the present invention.

FIG. 13 shows another embodiment of the handle unit 6, wherein the extension 62 comprises a first connection member 620, a second connection member 621 and a bolt 623. The first connection member 620 is connected to the driving post 61 and the second connection member 621 is connected to the second shaft 30. The first and second connection members 620, 621 are retractably connected to each other. The first connection member 620 includes multiple positioning holes 624 and the bolt 623 extends through the second connection member 621 and is inserted into one of the holes 624 such that the distance between the seat 4 and the handle 60 can be adjusted.

Figure 14:
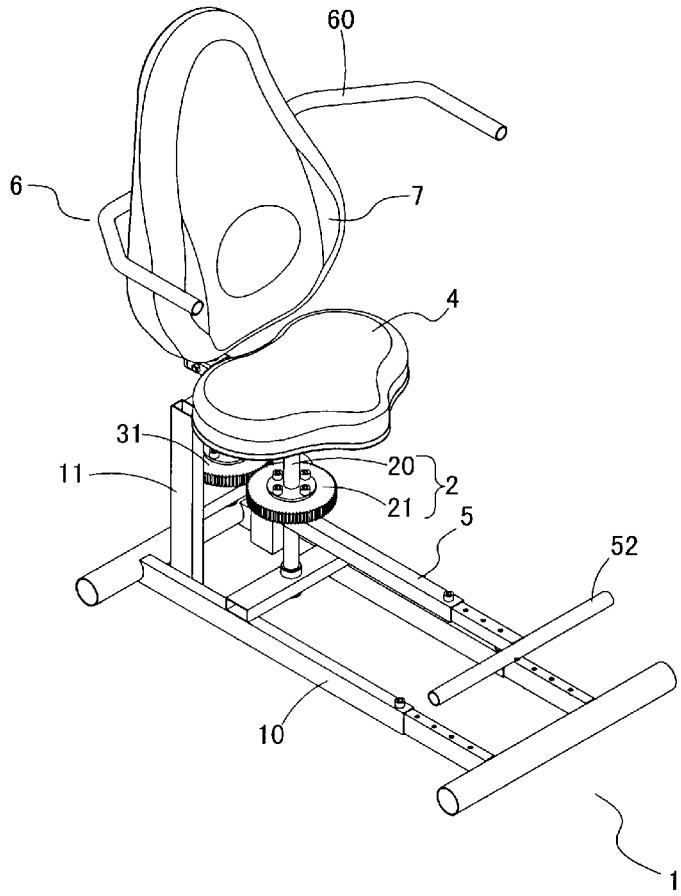
FIG. 14 shows another embodiment of the twist exerciser with a backrest of the present invention.

FIG. 14 shows that the twist exerciser includes a backrest 7 which is connected to the handle unit 6 so that the user's back can rest on the backrest 7.

While we have shown and described the embodiment in accordance with the present invention, it should be clear to those skilled in the art that further embodiments may be made without departing from the scope of the present invention.

What is claimed is:

1. A twist exerciser comprising:

a base;

a first gear unit comprising a first shaft and a first gear which is fixed to the first shaft, the first shaft rotatably connected to the base and the first gear co-rotated with the first shaft;

a second gear unit comprising a second shaft and a second gear which is fixed to the second shaft, the second shaft rotatably connected to the base and the second gear co-rotated with the second shaft;

a seat connected to a top end of the first shaft and co-rotated with the first gear;

a feet rest having a first end fixed to the first shaft and a second of the feet rest having a transverse bar, and a handle unit having a handle which drives the second shaft, the handle unit comprising a driving post and a foam tube, the driving post having a top end connected to the handle and a bottom end of the driving post connected with the second shaft, the foam tube mounted to the driving post, the driving post comprising a spring, an upper tube unit and a lower tube unit, the upper tube unit having a top end connected to the handle and a ton end of the spring mounted to a bottom end of the upper tube unit, a lower end of the spring mounted to a top end of the lower tube unit and a bottom end of the lower tube unit connected to the second shaft, the foam tube mounted to the spring, the handle unit comprising an extension which is connected between the bottom end of the lower tube unit and top end of the second shaft, the upper tube unit comprising a lower tube, an upper tube and a bolt the lower tube inserted into the spring and a top end of the upper tube connected to the handle, a bottom end of the upper tube inserted into the lower tube, the upper tube including multiple positioning holes, the bolt extending through the lower tube and inserted into one of the positioning holes.

2. The exerciser as claimed in claim 1, wherein a backrest is connected to the handle unit.

3. The exerciser as claimed in claim 1, wherein the base 1 comprises a main part and a connection frame which is connected to the main part, the first shaft is pivotably connected between the main part and the connection frame, the second shaft is pivotably connected to the connection frame.

4. The exerciser as claimed in claim 3, wherein the main part comprises a rear rod and a front rod, two outer tubes, two inner tubes and two bolts, the two outer tubes are parallel to each other and have two respective ends connected to the rear rod, the two inner tubes have two respective first ends inserted into the two outer tubes and two respective second ends of the two inner tubes are connected to the front rod, the two inner tubes each have multiple positioning holes, each of the two bolts extends through the outer tube corresponding thereto and is engaged with one of the positioning holes of the inner tube corresponding thereto.

5. The exerciser as claimed in claim 1, wherein the handle unit comprises an extension which is connected between the top end and the bottom end of the driving post.

6. The exerciser as claimed in claim 5, wherein the extension comprises a first connection member, a second connection member and a bolt, the first connection member is connected to the driving post and the second connection member is connected to the second shaft, the first and second connection members are retractably connected to each other, the first connection member includes multiple positioning holes and the bolt extends through the second connection member and is inserted into one of the holes.

* * * * *